US005472535A

United States Patent [19]

Mendenhall et al.

[11] Patent Number: 5,472,535

[45] Date of Patent: Dec. 5, 1995

[54] GAS GENERANT COMPOSITIONS CONTAINING STABILIZER

[75] Inventors: Ivan V. Mendenhall, Providence; Robert D. Taylor, Hyrum, both of Utah

[73] Assignee: Morton International, Inc., Chicago, Ill.

[21] Appl. No.: 417,550

[22] Filed: Apr. 6, 1995

[51] Int. Cl.[6] ..... C06B 47/08

[52] U.S. Cl. ..... 149/36; 149/22

[58] Field of Search ..... 149/36, 22

[56] References Cited

U.S. PATENT DOCUMENTS 3,468,730 9/1969 Gawlick et al. ..... 149/61

5,035,757 7/1991 Poole ..... 149/46

*Primary Examiner*—Ngoclan Mai

*Assistant Examiner*—Anthony R. Chi

*Attorney, Agent, or Firm*—Wayne E. Nacker; Gerald K. White

[57] ABSTRACT

To a gas generant composition comprising a fuel component which includes a triazole compound and/or tetrazole compound with an acidic hydrogen and an oxidizer component which includes a transition metal oxide, is added a chelating agent, such as ethylenediaminetetraacetic acid (EDTA) to provide long-term stability to the gas generant composition.

5 Claims, No Drawings

GAS GENERANT COMPOSITIONS CONTAINING STABILIZER

The present Invention is directed to gas generant compositions for inflating automotive air-bags and other devices in which rapid production of high volumes of gas is required. More particularly, the invention is directed to such compositions where tetrazoles and/or triazoles are the fuel component and metal oxides are employed as oxidizers and stabilization of such compositions.

BACKGROUND OF THE INVENTION

Most automotive air bag restraint systems, presently in use, use gas generant compositions in which sodium azide is the principal fuel. Because of disadvantages with sodium azide, particularly instability in the presence of metallic impurities and toxicity, which presents a disposal problem for unfired gas generators, there is a desire to develop non-azide gas generant systems, and a number of non-azide formulations have been proposed. However, to date, non-azide gas generants have not made significant commercial inroads.

Alternatives to azides which have been proposed, e.g., in U.S. Pat. No. 5,035,757, the teachings of which are incorporated herein by reference, include azole compounds, particularly tetrazole and triazole compounds. Tetrazole compounds include, for example, 5-amino tetrazole (5-AT), tetrazole, and bitetrazole. Triazole compounds include, for example, 1,2,4-triazole-5-one, and 3-nitro 1,2,4-triazole-5-one. Although all of the above azole compounds are useful fuels in accordance with the present invention, 5-AT is the most commercially important of these.

Gas generant systems include, in addition to the fuel component, an oxidizer component. Proposed oxidizers for use in conjunction with azole fuels include alkali and alkaline earth metal salts of nitrates, chlorates and perchlorates. Another type of oxidizer for tetrazoles and triazoles, as taught, for example, in U.S. Pat. No. 3,468,730, the teachings of which are incorporated herein by reference, are metal oxides, particularly transition metal oxides. Transition metal oxides suitable as oxidizers include, but are not limited to cupric oxide, ferric oxide, lead dioxide, manganese dioxide and mixtures thereof. Metal oxides are desired as oxidizers in that they tend to lower combustion temperatures, thereby lowering the generated levels of toxic oxides, such as CO and $NO_x$.

Several gas generant processing procedures utilize water. Water-processing reduces hazards of processing gas generant materials. It is therefore desirable that gas generant compositions be formulated so as to facilitate water processing.

One Example of water processing, taught, e.g., in U.S. Pat. No. 5,015,309, the teachings of which are incorporated by reference, involves the steps of 1. Forming a slurry of the generant ingredients with water.
2. Spray drying the slurry to form spherical prills of diameter 100–300 microns.
3. Feeding the prills via gravity flow to a high speed rotary press.

Another common production technique, (e.g. U.S. Pat. No. 5,084,218), the teachings of which are incorporated herein by reference, involves the following steps:

1. Forming a slurry of the generant ingredients with water.
2. Extruding the slurry to form spaghetti like strands.

3. Chopping and spheronizing the strands into prills.
4. Tableting of the prills as described previously.

A problem has been found with gas generant compositions containing both a triazole and/or a tetrazole having an acidic hydrogen plus a metal oxide oxidizer, a problem particularly seen if the composition is aqueous-processed, is poor long-term stability (as demonstrated by accelerated heat-aging experiments). Over time, the amount of the fuel is found to decrease and the performance decreases. Thus, if such a gas generant were used in an automotive airbag inflator, the inflator, over time, might become insufficiently effective. While Applicants are not bound by theory, it is believed that the metal ion of the metal oxide replaces, over time, acidic hydrogens of tetrazoles and/or triazoles, producing metal salts or complexes. These metal salts or complexes are somewhat unstable and, over time, decompose.

It is a primary object of the invention to stabilize gas generant compositions containing tetrazoles and/or triazoles having an acidic hydrogen plus a transition metal oxide oxidizer.

SUMMARY OF THE INVENTION

In a gas generant composition comprising a fuel component and an oxidizer component and in which at least part of the fuel component is a tetrazole compound having an acidic hydrogen and/or a triazole compound having an acidic hydrogen and in which at least part of the fuel component is a transition metal oxide, enhanced stability is provided by incorporating between about 0.05 and about 5 wt %, relative to total fuel component plus total oxidizer component (fuel component plus oxidizer component being 100 wt %), of a chelating agent. The preferred chelating agents are aminocarboxylic acids and salts thereof, particularly ethylenediaminetetraacetic acid (EDTA) and salts thereof.

DETAILED DESCRIPTION OF CERTAIN PREFERRED EMBODIMENTS

By acidic hydrogen on a triazole or tetrazole compound is meant herein a hydrogen that is on a triazole ring nitrogen or tetrazole ring nitrogen. When a triazole or tetrazole compound is compounded with a metal oxide, long-term instability tends to result. The use of a chelating agent in accordance with the invention eliminates or minimizes this instability problem.

The tetrazole and/or triazole compound of the fuel component may be selected from any of those listed above and mixtures thereof. From an availability and cost standpoint, 5-aminotetrazole (5-AT) is presently the azole compound of choice, although the instability problem addressed by the present invention is applicable to any tetrazole or triazole compound having an acidic hydrogen. The fuel may be entirely tetrazole, e.g., as per above-referenced U.S. Pat. No. 3,468,730, and/or triazole, but may be a mixture of fuels including a tetrazole and/or triazole and another fuel. Stability problems of significance in any such gas generant wherein the tetrazole and/or triazole comprises 10 wt % or more by weight of the total of the fuel component plus oxidant component. Likewise, the oxidizer may be entirely a metal oxide or mixture of metal oxides or a mixture of metal oxide(s) and non-metal oxide oxidizers. Stability problems of significance occur in any such gas generant wherein the metal oxide component comprises about 5 wt % or more of the total of the fuel component plus oxidizer component. The purpose of the fuel is to produce carbon dioxide, water and nitrogen gases when burned with an appropriate oxidizer or oxidizer combination. The gases so produced are used to inflate an automobile gas bag or other such device. By way of example, 5-AT is combusted to produce carbon dioxide, water and nitrogen according to the following equation:

$$2CH_3N_5+7/2O_2 \rightarrow 2CO_2+3H_2O+5N_2.$$

In accordance with the invention, long-term stability is provided by inclusion of a metal chelating agent at a level of between about 0.05 and about 5 wt %, preferably between 0.1 and 1 wt %, relative to the total of the fuel component plus the oxidizer component. Preferred chelating agents are aminocarboxylic acids and their salts. From a cost and availability standpoint, the preferred chelating agent is EDTA and its salts, such as disodium EDTA, tetrasodium EDTA, and potassium salts of EDTA. Example of other aminocarboxylic acids are hydroxyethylenediaminetriacetic acid, nitrilotriacetic acid, N-dihydroxyethylglycine, and ethylenebis(hydroxyphenylglycine). Suitable alternative types of chelating agents include polyphosphates, 1,3-diketones, hydroxycarboxylic acids, polyamines, aminoalcohols, aromatic heterocyclic base, phenols, aminophenols, oximes, Schiff bases, tetrapyrroles, sulfur compounds, synthetic macrocyclic compounds, and phosphoric acids.

To facilitate processing in conjunction with water, a minor portion of the fuel, i.e., between about 15 and about 50 wt % of the fuel, is preferably water soluble. While water-soluble oxidizers, such as strontium nitrate also facilitate water-processing, over-reliance on such water-soluble oxidizers tend to produce undesirably high combustion temperatures. Specific desirable characteristics of water soluble fuels are:

The compound should be readily soluble in water, i.e., at least about 30 gm/100 ml. $H_2O$ at 25° C.;

The compound should contain only elements selected from H, C, O and N;

When formulated with an oxidizer to stoichiometrically yield carbon dioxide, nitrogen, and water, the gas yield should be greater than about 1.8 moles of gas per 100 grams of formulation; and When formulated with an oxidizer to stoichiometrically yield carbon dioxide, water and nitrogen, the theoretical chamber temperature at 1000 psi should be low, preferably, less than about 1800° K.

Compounds that most ideally fit the above criteria are nitrate salts of amines or substituted amines. Suitable compounds include, but are not limited to, the group consisting of guanidine nitrate, aminoguanidine nitrate, diaminoguanidine nitrate, semicarbazide nitrate, triaminoguanidine nitrate, ethylenediamine dinitrate, hexamethylene tetramine dinitrate, and mixtures of such compounds. Guanadine nitrate is the currently preferred water-soluble fuel.

Generally any transition metal oxide may serve as an oxidizer. The preferred transition metal oxide is cupric oxide which, upon combustion of the gas generant, produces copper metal as a slag component. The purpose of the oxidizer is to provide the oxygen necessary to oxidize the fuel; for example, CuO oxidizes 5-AT according to the following equation:

$$4CH_3N_5+14CuO \rightarrow 14Cu+4CO_2+6H_2O+10N_2.$$

The transition metal oxide may comprise the sole oxidizer or it may be used in conjunction with other oxidizers including alkali and alkaline earth metal nitrates, chlorates and perchlorates and mixtures of such oxidizers. Of these, nitrates (alkali and/or alkaline earth metal salts) are preferred. Nitrate oxidizers increase gas output slightly. Alkali metal nitrates are particularly useful as ignition promoting additives.

It is frequently desirable to pelletize the gas generant composition. If so, up to about 5 wt %, typically 0.2–5 wt % of a pressing aid or binder may be employed. These may be selected from materials known to be useful for this purpose, including molybdenum disulfide, polycarbonate, graphite, Viton, nitrocellulose, polysaccharides, polyvinylpyrrolidone, sodium silicate, calcium stearate, magnesium stearate, zinc stearate, talc, mica minerals, bentonite, montmorillonite and others known to those skilled in the art. A preferred pressing aid/binder is molybdenum disulfide. If molybdenum disulfide is used, it is preferred that an alkali metal nitrate be included as a portion of the oxidizer. Alkali metal nitrate in the presence of molybdenum disulfide results in the formation of alkali metal sulfate, rather than toxic sulfur species. Accordingly, if molybdenum disulfide is used, alkali metal nitrate is used as a portion of the oxidizer in an amount sufficient to convert substantially all of the sulfur component of the molybdenum disulfide to alkali metal sulfate. This amount is at least the stoichiometric equivalent of the molybdenum disulfide, but is typically several time the stoichiometric equivalent. On a weight basis, an alkali metal nitrate is typically used at between about 3 and about 5 times the weight of molybdenum disulfide used.

The gas generant composition may optionally contain a catalyst up to about 3 wt %, typically between about 1 and about 2 wt %. Boron hydrides and iron ferricyanide are such combustion catalysts. Certain transition metal oxides, such as copper chromate, chromium oxide and manganese oxide, in addition to the oxidizer function, further act to catalyze combustion.

To further reduce reaction temperature, coolants may also optionally be included at up to about 10 wt %, typically between about 1 and about 5 wt %. Suitable coolants include graphite, alumina, silica, metal carbonate salts, and mixtures thereof. The coolants may be in particulate form, although if available, fiber form is preferred, e.g., graphite, alumina and alumina/silica fibers.

The invention will now be described in greater detail by way of specific examples.

EXAMPLE 1

A gas generant composition was prepared by mixing 15 wt % 5-aminotetrazole (5-AT) with 85 wt % cupric oxide. Two mixtures were prepared by combining the ingredients in an aqueous slurry, mixing well, and drying in a vacuum oven. A control sample contained only the CuO and the 5-AT. To an experimental sample was added 0.1% $Na_2$-EDTA. Accelerated aging was conducted by subjecting each of the Control and Experimental samples to 107° C. heat for 100 hours. Results are as follows:

| Sample | wt % 5-AT* | Burn rate in/sec | Appearance |
|---|---|---|---|
| Control/no aging | 15.08 | .420 | Navy blue |
| Control/aged | 12.88 | .421 | Navy blue |
| Exp./no aging | 14.21 | .520 | Grey/black |
| Exp./aged | 14.92 | .660 | Grey/black |

*analyzed

The lower 5-AT content of the Experimental sample (noaging) was due to a higher initial moisture content in the Experimental sample as well as a small amount of dilution by the added $Na_2EDTA$. Heat aging of the Experimental sample drove off the excess water, and the 5-AT content increased as a percentage of the mixture comparable to that of the control (no heat age) sample. However, in the Control sample, the 5-AT content decreased to 12.88% upon heat aging, indicating a loss of 5-AT. The lower burn rates obtained with the Control samples is believed to be due to the formation of the copper salt or complex of 5-AT and decomposition thereof during the manufacturing process. Also, the formation of the salt or complex is believed to be responsible for the blue color observed in the Control samples. It is believed that addition of EDTA to the mix prior to slurrying inhibits formation of this salt; thus, the higher burn rates and lack of blue color in the Experimental samples. The increase in burn rate observed in the heat aged Experimental sample relative to the non-heat aged Experimental sample is believed to be due to removal of excess moisture during heat aging.

What is claimed is:

1. Gas generant compositions comprising a fuel component and an oxidizer component, said fuel component comprising a tetrazole compound having an acidic hydrogen and/or a triazole compound having an acidic hydrogen and said fuel component comprising a transition metal oxide, wherein the improvement comprises said gas generant composition containing a chelating agent at between about 0.05 and about 5 wt % relative to the total weight of said fuel component and said oxidizer component.

2. A gas generant composition according to claim 1 wherein said tetrazole compound and/or said triazole compound is present at at least about 10 wt % of the total of said fuel component plus said oxidizer component.

3. A gas generant composition according to claim 1 wherein said transition metal oxide is present at at least about 5 wt % of the total of said fuel component plus said oxidizer component.

4. A gas generant composition according to claim 1 wherein said chelating agent is an aminocarboxylic acid or salt thereof.

5. A gas generant composition according to claim 1 wherein said chelating agent is ethylenediaminetetraacetic acid or salt thereof.

* * * * *